US006055700A

United States Patent [19]

Holsten et al.

[11] Patent Number: 6,055,700

[45] Date of Patent: May 2, 2000

[54] WET/DRY VACUUM WITH SNAP-ACTION POWERHEAD LATCH

[75] Inventors: Stuart V. Holsten, O'Fallon; Michael F. Martin, St. Charles; Chris Steger, O'Fallon, all of Mo.

[73] Assignee: Emerson Electric Co., St. Louis, Mo.

[21] Appl. No.: 09/063,756

[22] Filed: Apr. 21, 1998

[51] Int. Cl.[7] ..... A47L 5/00; E05C 19/10

[52] U.S. Cl. ..... 15/327.2; 15/327.6; 15/329; 15/412; 220/326; 292/108; 292/128; 292/228

[58] Field of Search ..... 15/327.2, 327.1, 15/327.6, 328, 329, 412, 330; 220/324, 326; 292/128, 108, 228, DIG. 11

[56] References Cited

U.S. PATENT DOCUMENTS

| | | | |
|---|---|---|---|
| 2,335,031 | 11/1943 | Stevens . | |
| 3,612,590 | 10/1971 | Andreini et al. | 292/76 |
| 3,797,870 | 3/1974 | Bechman | 70/84 |
| 3,876,104 | 4/1975 | Minsky et al. | 220/318 |
| 4,068,872 | 1/1978 | Smith | 292/87 |
| 4,138,151 | 2/1979 | Nakao | 292/76 |
| 4,496,177 | 1/1985 | Pissot | 292/87 |
| 4,501,378 | 2/1985 | Berfield | 220/324 |
| 5,234,124 | 8/1993 | Buckner, III et al. | 220/326 |
| 5,404,614 | 4/1995 | Stephens | 15/327.2 |
| 5,535,500 | 7/1996 | Stephens et al. | 29/453 |
| 5,548,868 | 8/1996 | Berfield et al. | 15/339 |
| 5,611,107 | 3/1997 | Tomasiak et al. | 15/327.2 |

*Primary Examiner*—William H. Beisner

[57] ABSTRACT

A vacuum appliance is disclosed, comprising a collection canister having a lid and a powerhead housing a motor and impeller assembly for establishing vacuum pressure within said canister. The powerhead is removably secured to the lid of the collection canister, such that the powerhead can be removed from the lid and separately used as a blower. Self-actuationg latching devices are provided for removably securing the powerhead to the lid. In one embodiment, the latching device is a unitary, multi-segmented structure having a spring biasing member and a retaining member formed integrally therewith. A journal formed integrally with the latching device is adapted to be received in a bearing defined in a latch socket on the lid, such that the latching device is allowed to pivot with respect to the lid. The spring biasing member functions to bias the latching device to a home pivot position, such that the latching device automatically engages the powerhead when it is lowered onto the lid. In another embodiment, the latching device is cantilevered structure having a spring biasing member formed integrally therewith.

35 Claims, 14 Drawing Sheets

FIG. 6
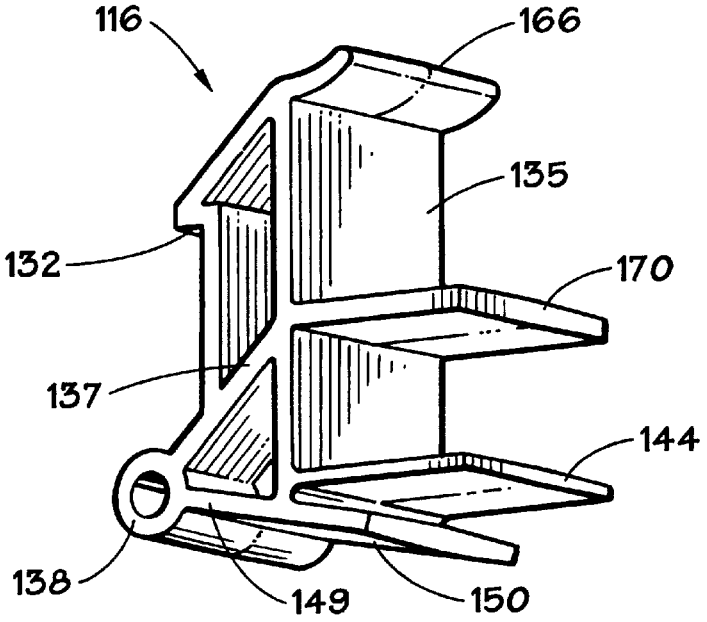
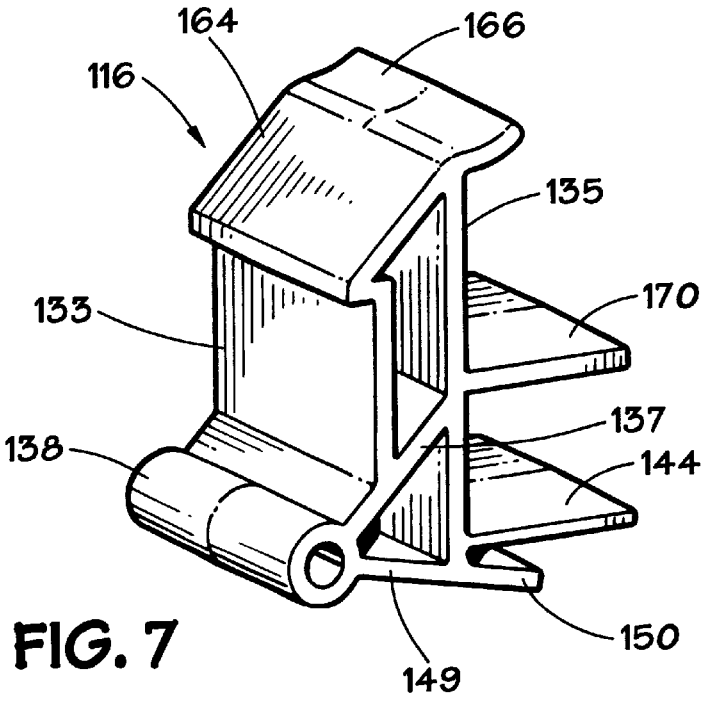
FIG. 7

WET/DRY VACUUM WITH SNAP-ACTION POWERHEAD LATCH

FIELD OF THE INVENTION

This invention relates generally to the field of vacuum appliances, and more particularly relates to a vacuum adapted to pick up wet and dry materials.

BACKGROUND OF THE INVENTION

Vacuum appliances capable of picking up both wet and dry material, commonly referred to as wet/dry vacuums or wet/dry vacs, are well-known. Wet/dry vacs are often used in workshops and other environments where both wet and dry debris can accumulate.

Wet/dry vacs conventionally consist of a collection tank or canister, sometimes mounted on wheels or casters, and a powerhead within which a motor and impeller assembly is mounted. The motor and impeller assembly creates a suction within the canister, such that debris and/or liquid is drawn in to the canister through an air inlet to which a flexible hose can be attached. A filter within the canister prevents incoming debris from escaping from the canister while allowing filtered air to escape. Any liquid drawn into the canister is diffused and accumulates on the bottom of the canister.

Wet/dry vacs are commercially available in a variety of sizes and configurations. The capacity, i.e., size, of a wet/dry vacuum collection canister is typically measured in gallons. In most if not all cases, the vacuum collection canister has a round or cylindrical configuration, since such a configuration represents the stablest pressure vessel, capable of withstanding the very large negative pressure (vacuum) forces that can be generated within a wet/dry vac.

Wet/dry vacs are also known in which the powerhead is detachable from the collection canister, enabling the powerhead to be used as a blower. These types of appliances are often referred to as blower/vacs. One example of a prior art blower/vac is U.S. Pat. No. 5,606,769 to Tomasiak et al., entitled "Wet/Dry Utility Vacuum Cleaner with Detachable Blower." The Tomaskiak et al. '769 patent is commonly assigned to the assignee of the present invention, and is hereby incorporated by reference herein in its entirety.

SUMMARY OF THE INVENTION

The present invention is directed to a vacuum appliance having numerous features believed to be advantageous. In one embodiment, the vacuum is of the type having a powerhead that is removable from the canister and lid, such that the powerhead can be used separately as a blower.

In accordance with one embodiment of the invention, latching means are provided for releasably securing the powerhead to the collection canister's lid. In one embodiment, the latching means is self-actuating, such that the powerhead is automatically secured to the lid with a "snap action" when the powerhead is lowered into a recess defined in the lid for receiving at least a bottom portion of the powerhead. The self-actuation is facilitated by a spring biasing member that is integrally formed with the latching means.

In one embodiment, the latching means is a unitary, multi-segmented structure including a journal adapted to be received in a bearing defined in a latch socket on the lid of the vacuum appliance. An integral retaining member is deflected as the latching means is installed into the socket, such that once installed, the latching means cannot be removed from the lid and is pivotally secured thereto.

In another embodiment, the latching means is a cantilevered structure. A moment is induced by offseting the latching member from the front of the cantilevered structure, such that under load, the latch tends to tighten its engagement with the powerhead.

BRIEF DESCRIPTION OF THE DRAWINGS

The foregoing and other features and aspects of the present invention will perhaps be best understood with reference to a detailed description of specific embodiments of the invention, when read in conjunction with the accompanying drawings, wherein:

FIG. 6 is a perspective view of the powerhead latch of the blower/vac from FIG. 1;

FIG. 7 is an alternative perspective view of the powerhead latch from FIG. 6;

DETAILED DESCRIPTION OF SPECIFIC EMBODIMENTS OF THE INVENTION

Figure 1:
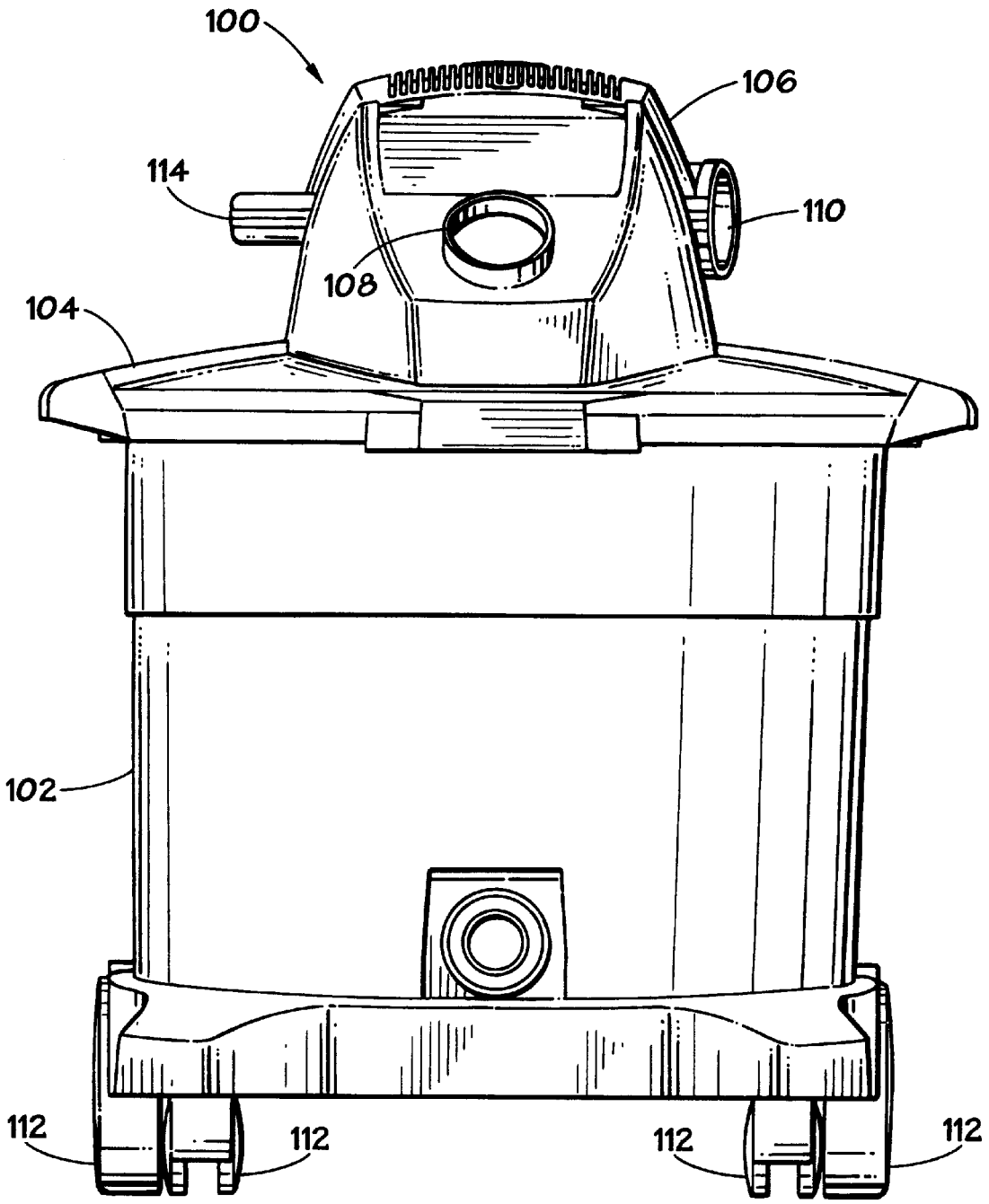
FIG. 1 is a front view of a combination blower and vacuum appliance ("blower/vac") in accordance with one embodiment of the invention.
Figure 2:
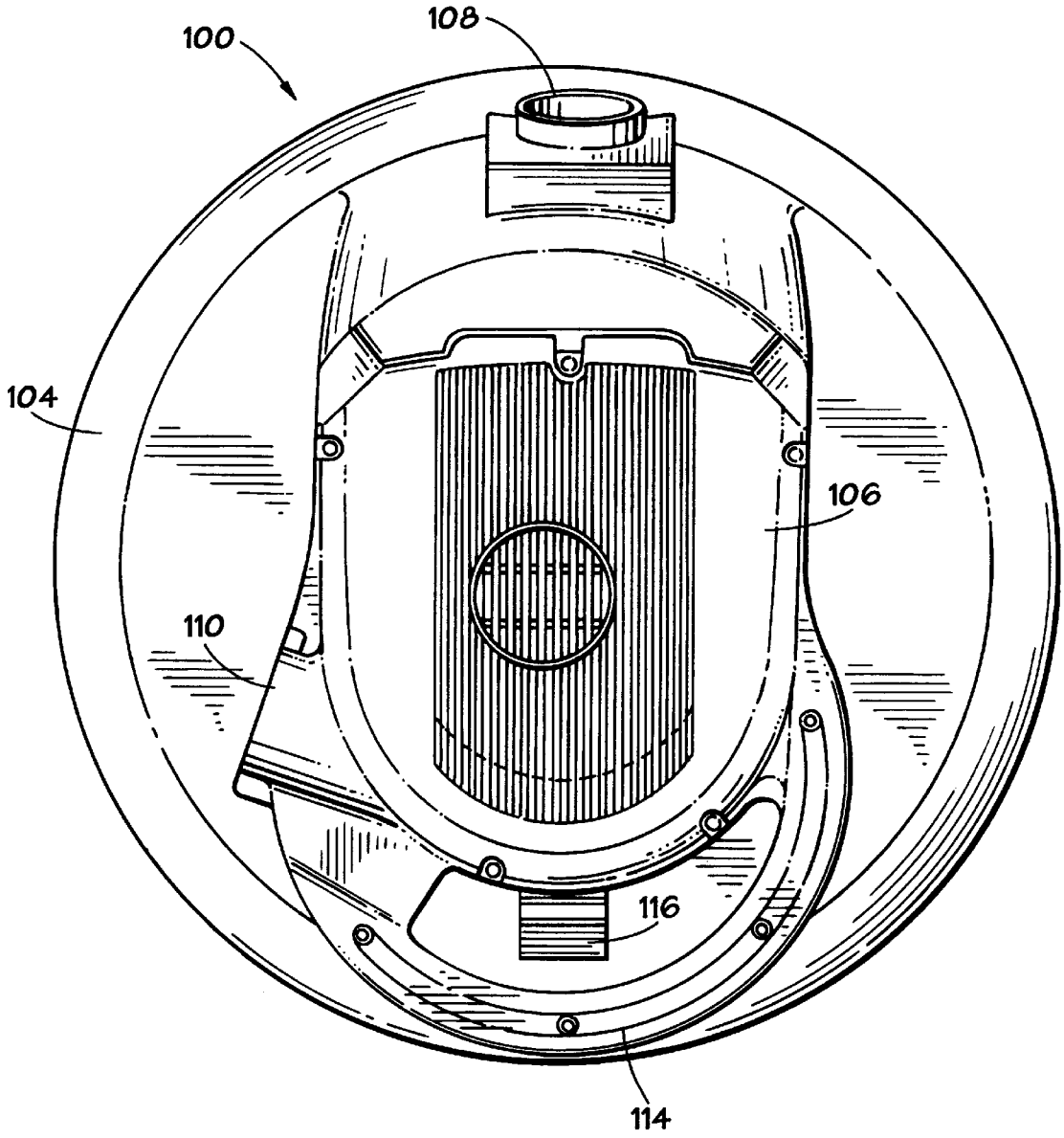
FIG. 2 is a top view of the blower/vac from FIG. 1.

Referring to FIGS. 1 and 2, there are shown front and top views, respectively, of a combination blower and vacuum (blower/vac) 100 in accordance with one embodiment of the present invention. As shown in FIGS. 1 and 2, blower/vac 100 comprises a collection canister 102 having a lid 104 and a detachable powerhead assembly 106 adapted to have a bottom portion thereof received within a recess 118 defined in lid 104. Collection canister 102, lid 104 and the exterior housing of powerhead 106 are preferably made injection-molded plastic, such as polypropylene or the like, in accordance with conventional practice.

In accordance with conventional designs, an air inlet port 108 is defined in lid 104 (or, alternatively, may be defined in a side wall of collection canister 102). Powerhead 106 houses a motor and impeller assembly, and has defined therein an air exhaust or outlet port 110. When operated in vacuum mode, the motor and impeller assembly functions to create a suction (negative pressure) within the collection canister, such that air is drawn in through inlet port 108, filtered, and exhausted through air outlet port 110. A flexible vacuum hose (not shown) has a proximal end adapted to be received, by friction-fit, for example, in vacuum inlet 108. One or more accessory nozzles (also not shown) can be fitted to the distal end of the hose, in a conventional arrangement.

With continued reference to FIGS. 1 and 2, canister 102 may be provided with front and rear casters and/or wheels 112 for allowing blower/vac 100 to be easily transported.

The design and operation of a combination blower and vacuum as thus far described herein are very well known to those of ordinary skill in the art. It is believed that it is therefore not necessary to discuss many of the design details, for example, the configuration of the filter assembly, construction of the motor and impeller assembly, and so forth, herein.

When it is desired to utilize powerhead 106 as a blower, powerhead 106 may be detached from lid 104, as will be hereinafter described in further detail. A handle 114 is formed in powerhead 106, such that powerhead 106 may be conveniently grasped with one hand, with air outlet 110 facing generally forward of the user. In the blower mode of operation, blower attachments, such as extension wands, blower nozzles and the like, may be attached to air outlet port 110, enabling the user to direct the stream of air exhausted from powerhead 106.

As those of ordinary skill in the art will appreciate, for a blower/vac having a detachable powerhead, it is desirable to provide a latching mechanism which, while reliably securing the power head to the canister lid during operation as a vacuum, also allows the powerhead to be easily released from the canister lid when it is desired to utilize the powerhead as a blower. One example of a prior art latching mechanism is disclosed in U.S. Pat. No. 5,611,107 to Tomasiak et al., entitled "Latching Mechanisms for Wet/Dry Utility Vacuum Cleaner With Detachable Blower." The Tomasiak et al. '107 patent is a continuation-in-part of the above-referenced Tomasiak '769 patent, is commonly assigned to the assignee of the present invention, and is hereby incorporated by reference herein in its entirety.

In FIG. 2, a latching mechanism in accordance with one embodiment of the invention is designated with reference numeral 116.

Figure 3:
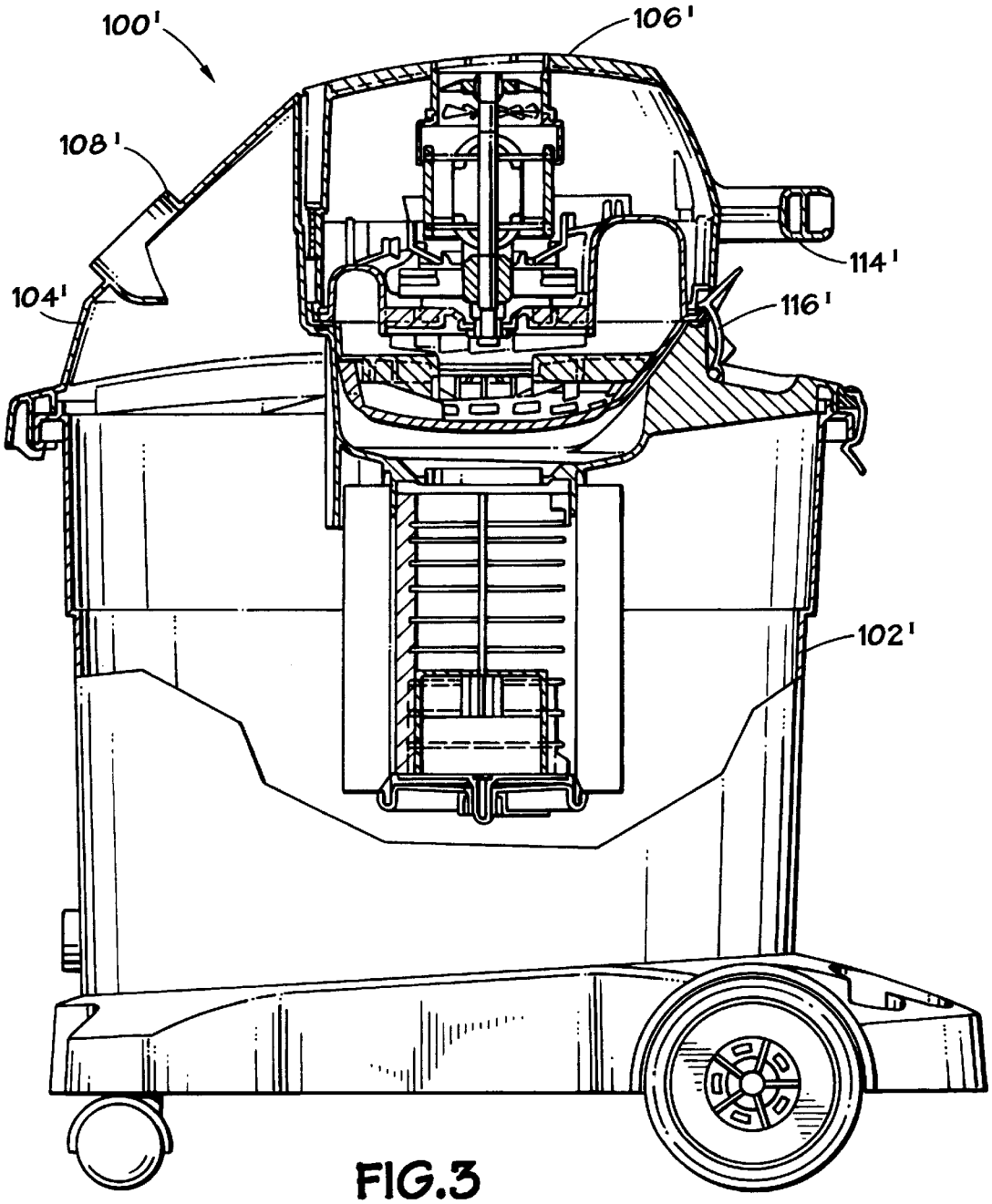
FIG.3 (PRIOR ART)
FIG. 3 is a partially cut-away side cross-sectional view of a prior art blower/vac.
Figure 4A:
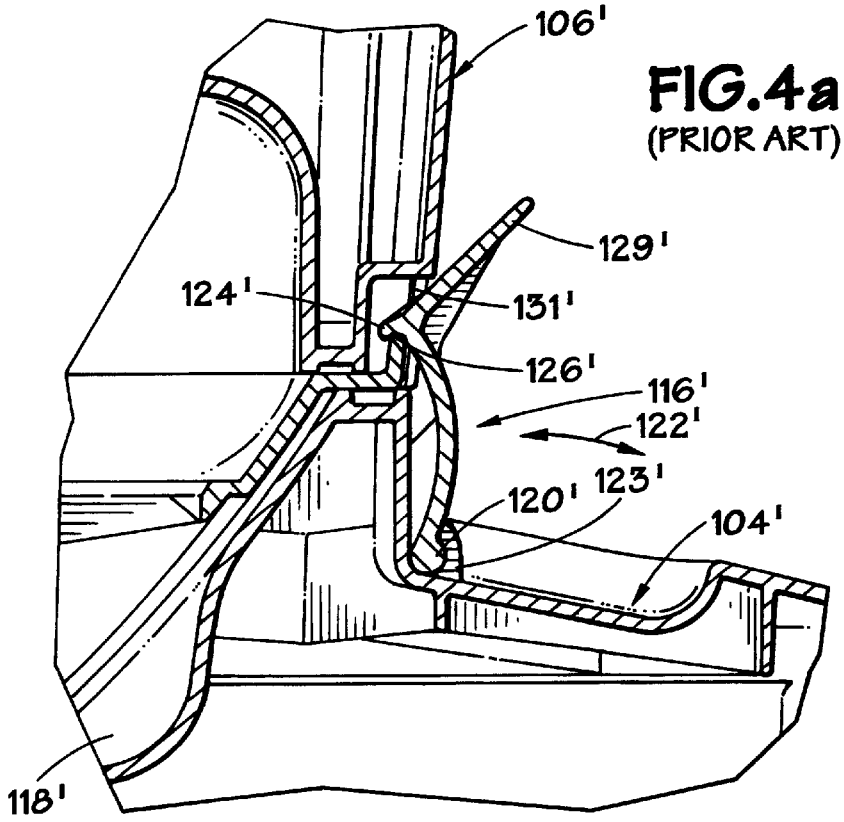
FIG.4a (PRIOR ART)
FIG. 4*a* is a side cross-sectional view of a powerhead latch from the prior art blower vac of FIG. 3.
Figure 4B:
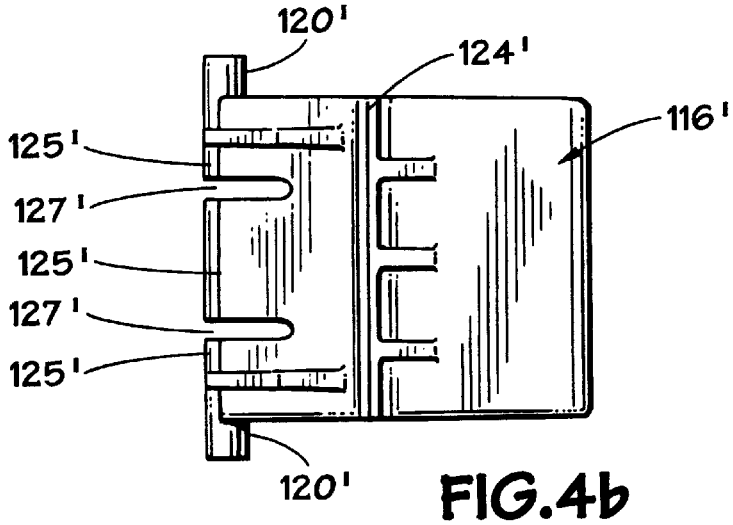
FIG.4b (PRIOR ART)
FIG. 4*b* is a top view of the latch from FIG. 4*a;*

By way of comparison, FIG. 3 is a partially cut-away cross-sectional view of a blower/vac 100' employing a prior art powerhead latching mechanism 116'. The latching mechanism 116' is also shown in the views of FIGS. 4*a* and 4*b*. (The convention of using "primed" reference numerals in FIGS. 3, 4*a*, and 4*b* is adopted to distinguish corresponding components of blower/vac 100 from FIGS. 1 and 2 from the prior art blower vac of FIGS. 3 and 4). As with blower/vac 100 from FIGS. 1 and 2, blower/vac 100' in FIGS. 3 and 4 includes a powerhead 106' which is received in a recess 118' in a collection canister lid 104'. The blower/vac of FIGS. 3, 4*a*, and 4*b* corresponds generally to that disclosed in the above-referenced Tomasiak et al. '769 patent.

As shown in the views of FIGS. 4*a* and 4*b*, the latching mechanism comprises a latch 116' having a journalled ends 120' pivotally mounted on lid 104', such that latch 116' can be rotated as indicated by arrow 122' in FIG. 4*a*. The spaced and aligned posts or journals 120' extend outwardly from latch 116' for reception within complementary shaped holes in spaced integral support plates 123' formed in lid 104' (see FIG. 4*a*). The upper end of the releasable blower latch 116', in alignment with the spaced journals 120' include a series of aligned and spaced sections 125' separated by openings 127', in order to allow the pivot posts or journals 120' to be resiliently deformed inwardly relative to the complementary shaped mounting holes provided in the spaced support plates 123'. Once the spaced and aligned journals 120' are received within the complementary shaped mounting holes of the spaced support plates 123', the aligned and spaced sections 125' and 127' return to their normal condition for securing blower latch 116' in an assembled position relative to the spaced support plates 123' of lid 104'.

At an opposite end from journals 120', latch 116' includes an upstanding handle 129' for moving the detachable blower latch 116' into engagement or disengagement relative to powerhead 104'. For this purpose, latch 116' includes a flexible latching rib 124' that resiliently engages a lower locking shoulder 126' in a complementary latch opening 131' formed in the powerhead housing, as best illustrated in FIG. 4*a*.

To detach powerhead 106' from lid 104', a user merely pulls down on a handle 129' of latch 116'. To reattach powerhead 106', it is replaced into recess 118' as shown in FIG. 4*a*. Latch 116' must then be lifted up so that latching rib 124' snaps into and engages lower locking shoulder 126'.

There are some potential disadvantages of the simple latching mechanism 116' of FIGS. 3 and 4. First, applied upward force from a user grasping or lifting the vac by handle 114' of powerhead 106' can tend to cause latching rib 124' to deflect, weakening the latching strength. Second, the latching operation is not automatic. That is, the user must actively snap latch 116' back into place once powerhead 106' is replaced into recess 118'. Third, latch 116' is not spring biased, i.e., there is no constant force present which tends to keep latch 116' in the latched position, thereby avoiding inadvertent detachment of powerhead 106'.

Turning now to FIGS. 5–13, there is illustrated a powerhead latching mechanism 116 for blower/vac 100 in accordance with the presently disclosed embodiment of the invention. As shown in the Figures, with blower/vac 100 in the vacuum mode, powerhead 106 is secured within a recess 118 in lid 104. A pivot mechanism comprising a pivot seat 130 and a lid pivot 128 provides a means for enabling powerhead 106 to be pivoted out from within recess 118. Latch 116 releasably secures powerhead 106 at the back through engagement of a latching surface 132 over a latching rib 134.

FIGS. 6 and 7 are alternative perspective views of latch 116 in accordance with the presently disclosed embodiment of the invention. Latch 116 is preferably a unitary (i.e., one-piece) structure made of molded polypropylene plastic or another suitably strong yet resilient material, as will hereinafter become apparent. As shown in FIGS. 6 and 7, while it is a unitary structure, latch 116 essentially comprises or defines multiple structural components.

In particular, latch 116 comprises a substantially cylindrical journal 138 about which latch 116 pivots, as well as a substantially planar front member 133 and a substantially planar rear member 135 spaced apart from and generally parallel to the front member 133. A substantially planar reinforcing rib member 137 extends from journal 138 and extends transversely (although not necessarily at right angles, as is apparent from the Figures) between front and rear members 133 and 135. A substantially planar bottom member 149 generally defines the bottom of latch 116, extending from journal 138 to rear member 135. A retaining member 150 extends generally rearward from bottom 149 and rear member 135. A spring member 144 likewise extends generally rearwardly from rear member 135, from generally near the intersection of retaining member 150 and rear member 135. A contacting member 164 extends between the front and rear members 133 and 135 at the end of latch 116 opposite journal 138.

The top of latch 116 is generally defined by contacting member 164 and a finger contact surface 166. The front of latch 116 is generally defined by front member 133 and journal 138, and the rear of latch 116 is generally defined by rear member 135, from which retaining member 150, spring member 144, and a cover member 170 all extend generally rearwardly.

Figure 8:
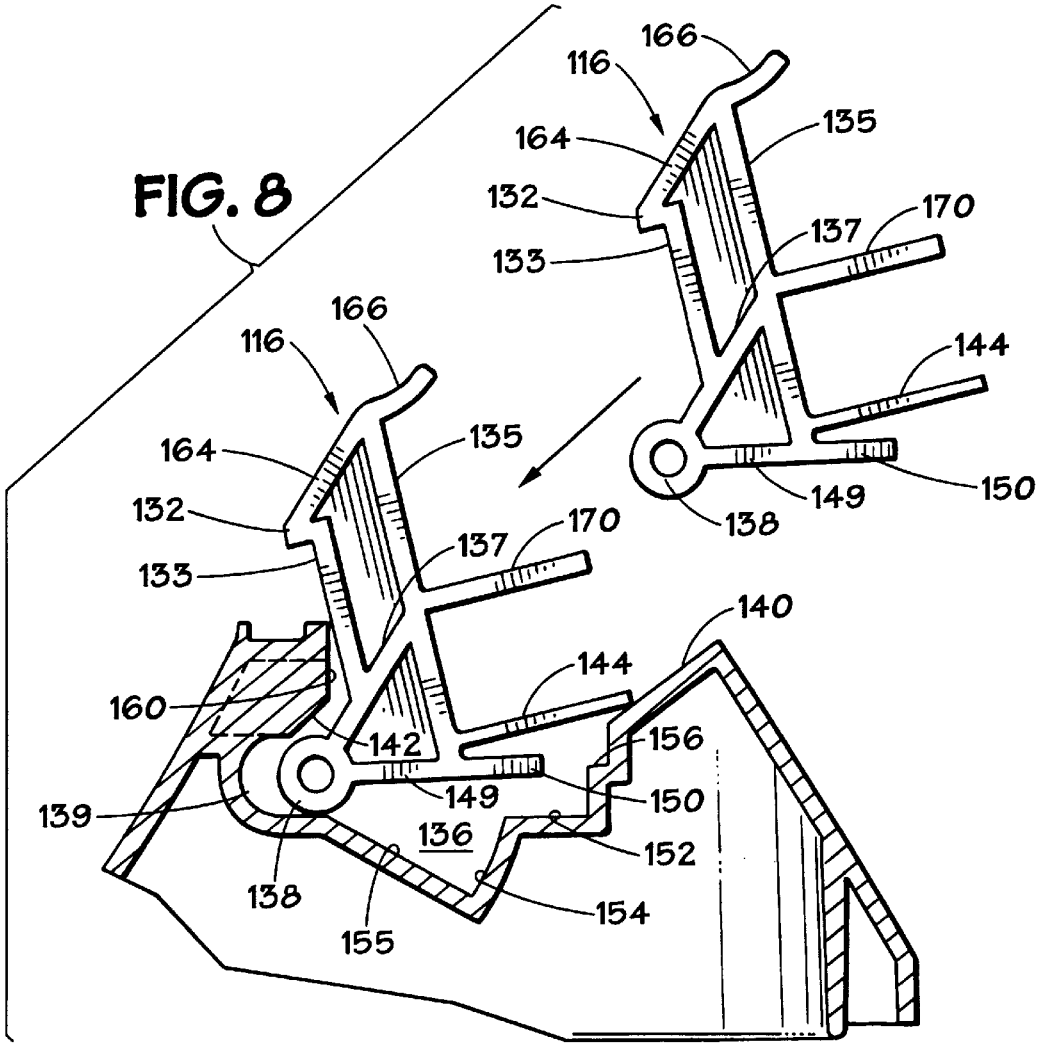
FIG. 8 is a partial side view showing a first stage of installation of the powerhead latch onto the lid of the blower/vac from FIG. 1.
Figure 9:
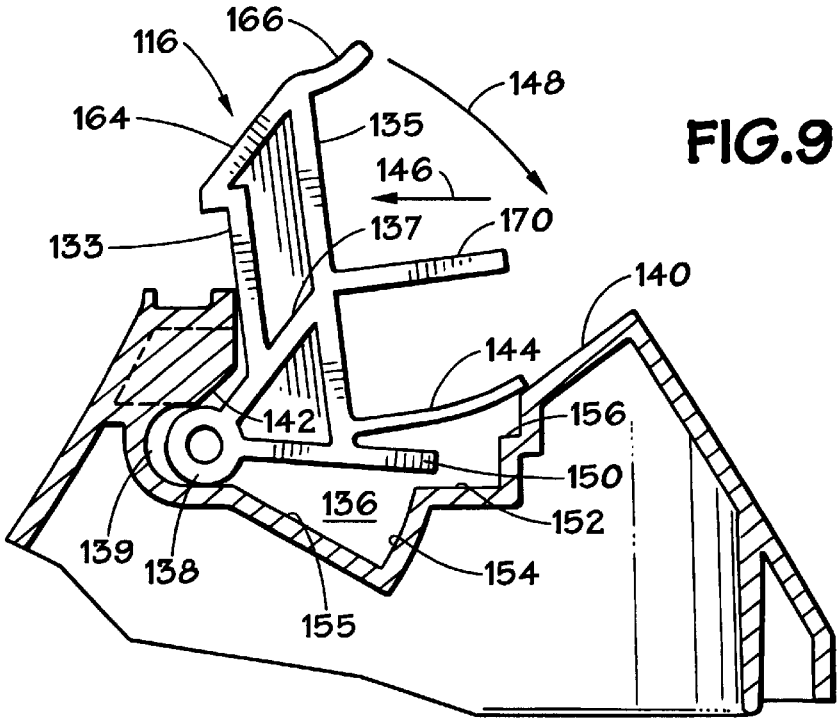
FIG. 9 is a partial side view showing a second stage of installation of the powerhead latch onto the blower/vac from FIG. 1.
Figure 10:
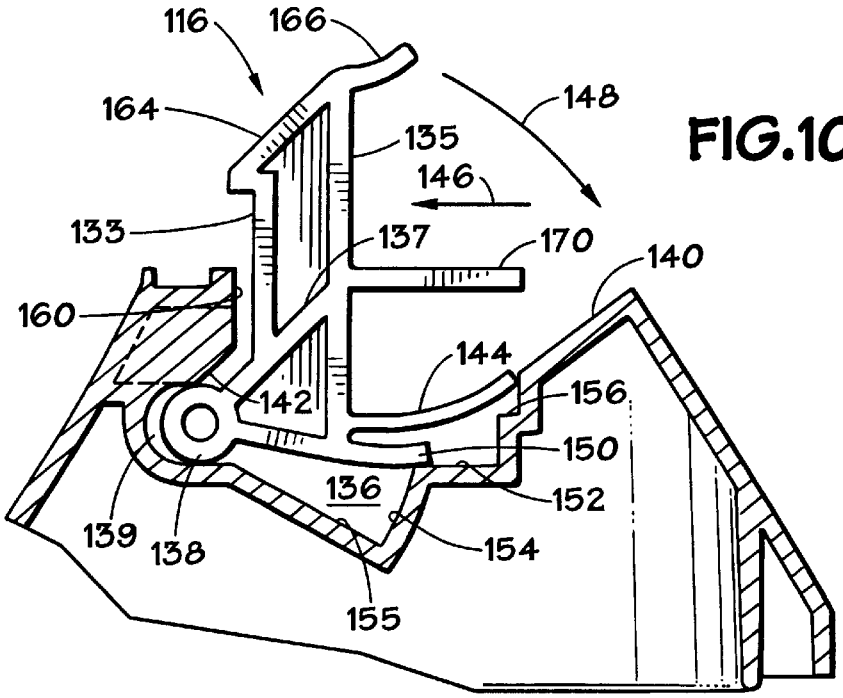
FIG. 10 is a partial side view showing a third stage of installation of the powerhead latch onto the lid of the blower/vac from FIG. 1.

In accordance with one advantageous aspect of the present invention, latching mechanism 116 requires no fasteners or the like to be permanently and pivotally secured to lid 104, and requires no tools to install or use. FIGS. 8–10 illustrate the process of installing latching mechanism onto lid 104. First, as shown in FIG. 8, latch 116 is inserted journal-end (i.e., bottom) first into a socket 136 formed in lid 104. Journal 138 of latch 116 is adapted to be received in a C-shaped bearing portion 139 of socket 136.

Figure 5:
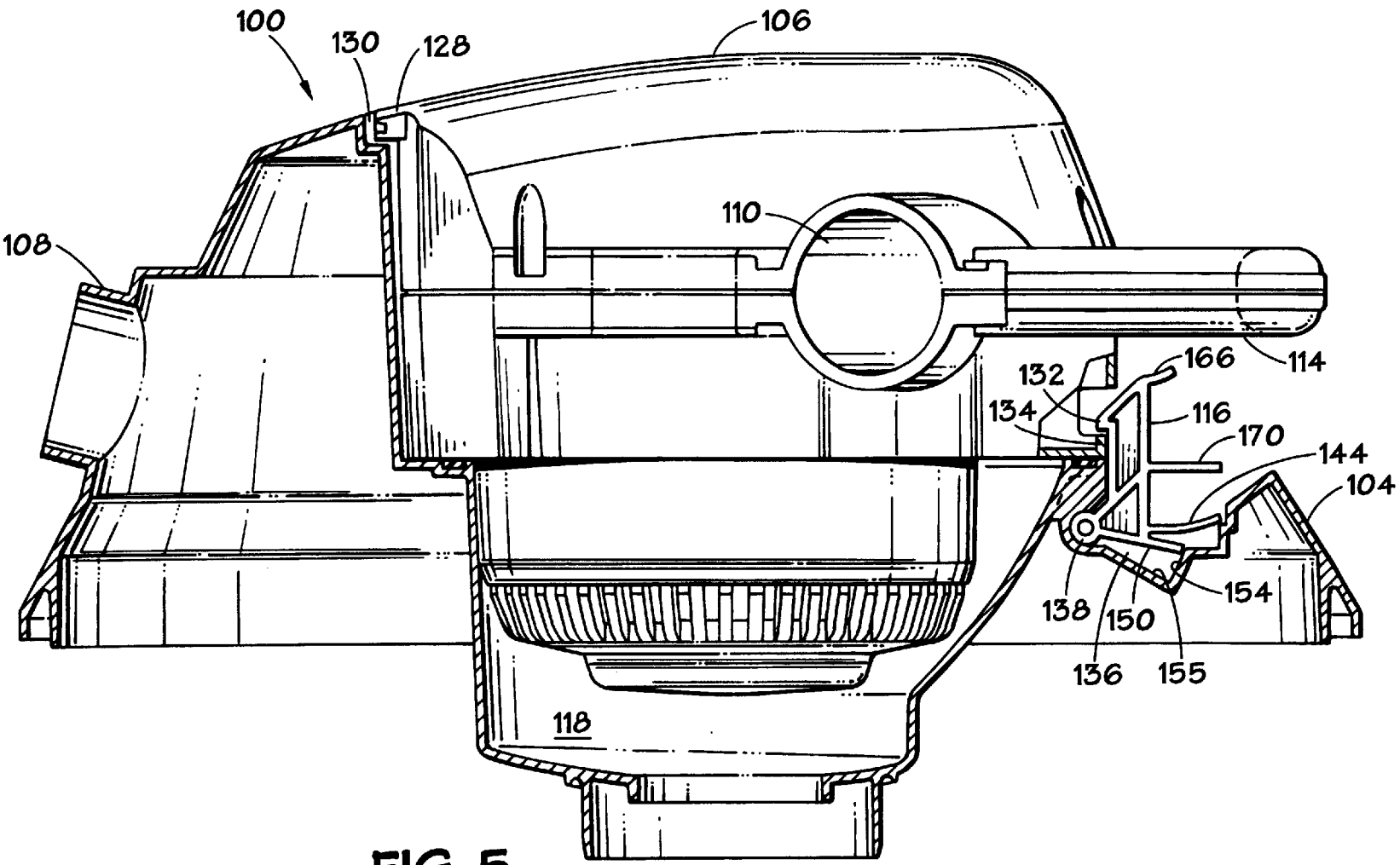
FIG. 5 is a partial side view of the blower/vac from FIG. 1 showing the powerhead thereof secured to the lid with a latch in accordance with one embodiment of the invention.

Lead-in surfaces 140 and 142 formed in lid 104 assist in guiding latch 116 into socket 136 As is apparent from FIGS. 9 and 10, as latch 116 is inserted into socket 136, sliding and pivoting as indicated by arrows 146 and 148 in FIGS. 9 and 10, latch biasing spring member 144 of latch 116 deflects around features of lid 104. Just before latch is completely installed, latch retaining member 150 contacts and deflects (see FIG. 10) around a floor 152 of socket 136. When latch 116 is fully inserted in socket 136, as shown in FIG. 5, journal 138 seats in bearing 139, and retaining member 150 "snaps" into an auxiliary bearing 154, riding against a bearing surface defined by this auxiliary bearing 154 as latch 116 is pivoted about journal 138. Also, spring member 144 snaps onto a spring wall 156. Auxiliary bearing 154 is preferably concentric with latch bearing 139, defining a generally arcurate bearing surface against which retaining member 150 rides as latch 116 is pivoted.

Figure 11:
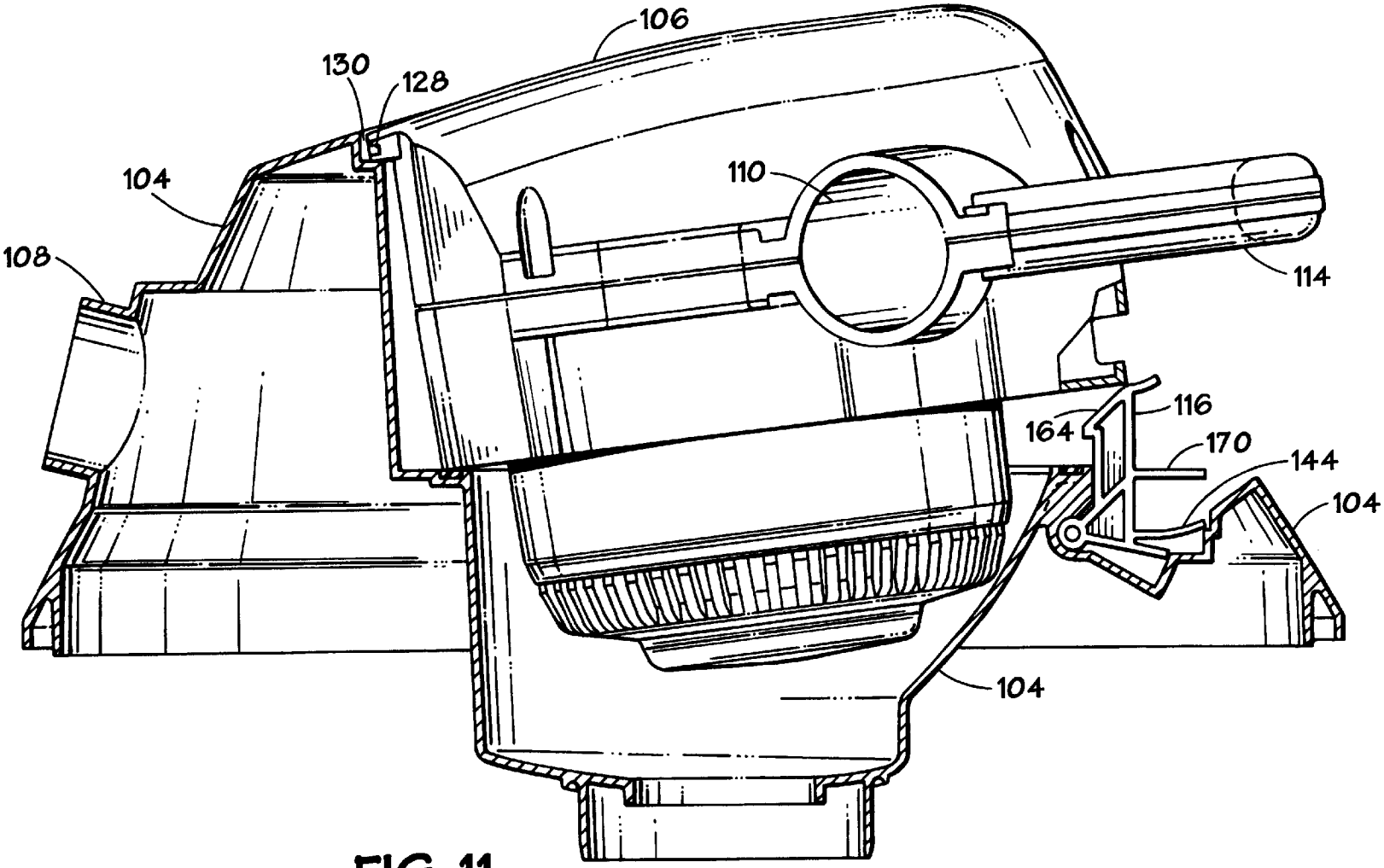
FIG. 11 is a partial side view showing a first stage of attachment of the powerhead to the lid of the blower/vac from FIG. 1.

Once installed, as shown in FIG. 11, latch 116 is not intended to be removable from lid 104, and cannot be easily removed from lid 104. This is because retaining member 150 must deflect around socket floor 152 as latch 116 is being installed, and there is no access beneath retaining member 150 to pry or otherwise deflect retaining member 150 up and out of auxiliary bearing 154. Also, importantly, front member 133 of latch 116 bumps against a bump wall 160 defined by lid 104 to keep latch 116 from rotating or pivoting far enough, in the direction urged by spring member 144, for retaining member 150 to clear auxiliary bearing 154. (On the other hand, pivoting of latch 116 in socket 136 in the direction opposed by spring member 144 is limited by retaining member 150 coming into contact with a bottom surface 155 of auxiliary bearing 154.) Thus, notably, the pivoting of latch 116 in either direction is restricted to such an extent that retaining member 150 is prevented from disengaging auxiliary bearing 154 and hence functions to retain latch 116 within socket 136.

From FIG. 5, it can be seen that when latch 116 is installed, spring member 144 is preloaded in its home position, resting against and slightly deflected by spring wall 156. This biases 116 into a closed or latched position.

Figure 12:
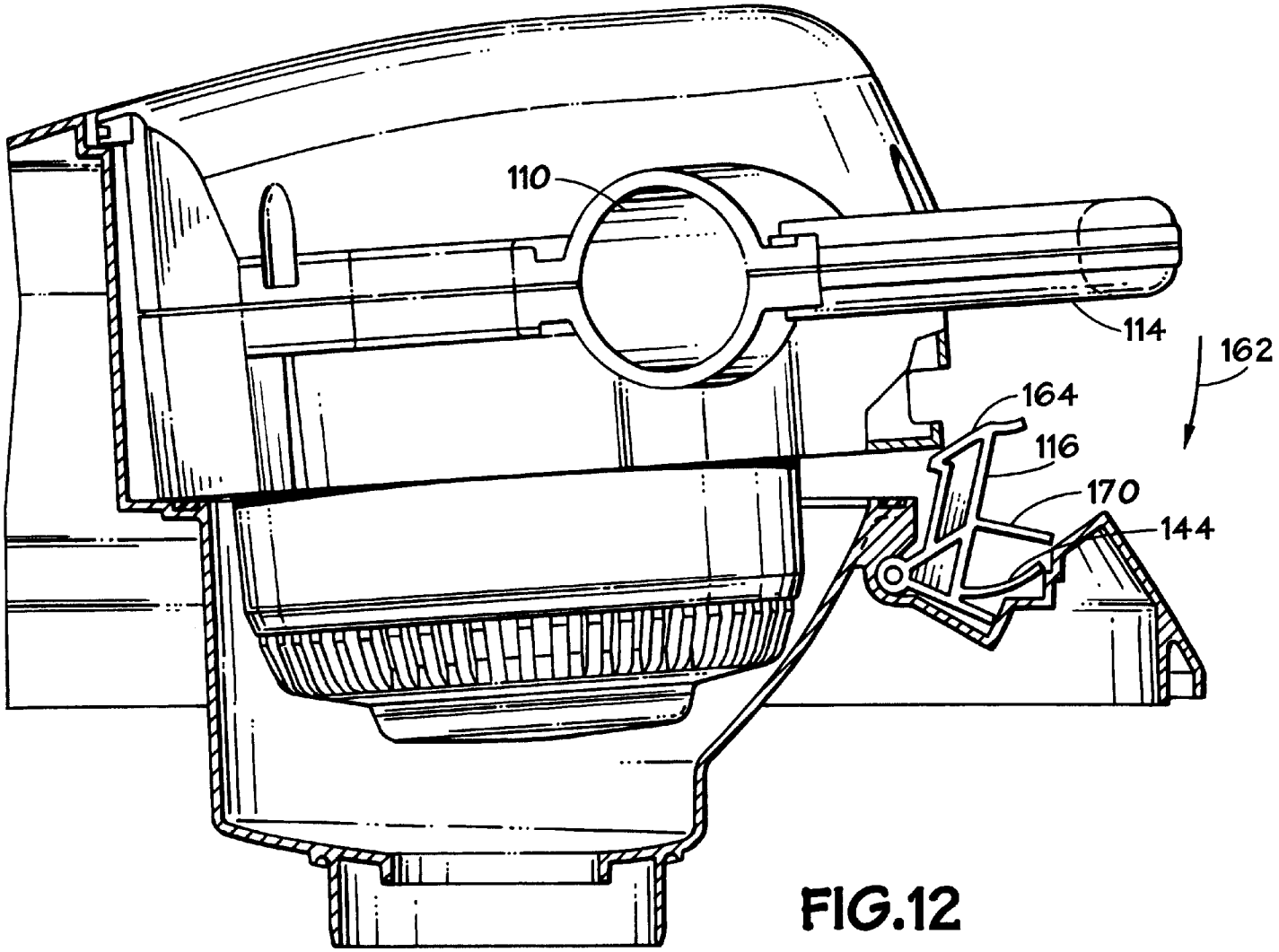
FIG. 12 is a partial side view showing a second stage of attachment of the powerhead to the lid of the blower/vac from FIG. 1.

Turning now to FIGS. 11 and 12, the process of installing and latching powerhead 106 onto lid 104 is illustrated. First, as shown in FIG. 11, lid pivot 131 is inserted over pivot seat 130. Then powerhead 106 is lowered, by pivoting pivot 131 within pivot seat 130. As it is lowered, as represented by arrow 162 in FIG. 12, powerhead 104 contacts and slides along a contacting surface 164 of latch 116. This causes latch 116 to rotate outward about journal 138 and bearing 139. Notably, contacting surface 164 additionally contributes to the structure of latch 116, as it extends between front and rear members 133 and 135.

It is to be noted that the more latch 116 rotates as it is deflected outward by powerhead 106 contacting contact surface 164, the more retaining member 150 rides against the bearing surface of and engages auxiliary bearing 154, in turn further preventing latch 116 from being detached from lid 104.

As powerhead 106 continues to be rotated down, it eventually comes to rest on lid 104, and latch 116 "snaps" back, as a result of the deflection of spring member 144, such that latching surface 132 engages latching rib 134, as shown in FIG. 5.

Figure 13:
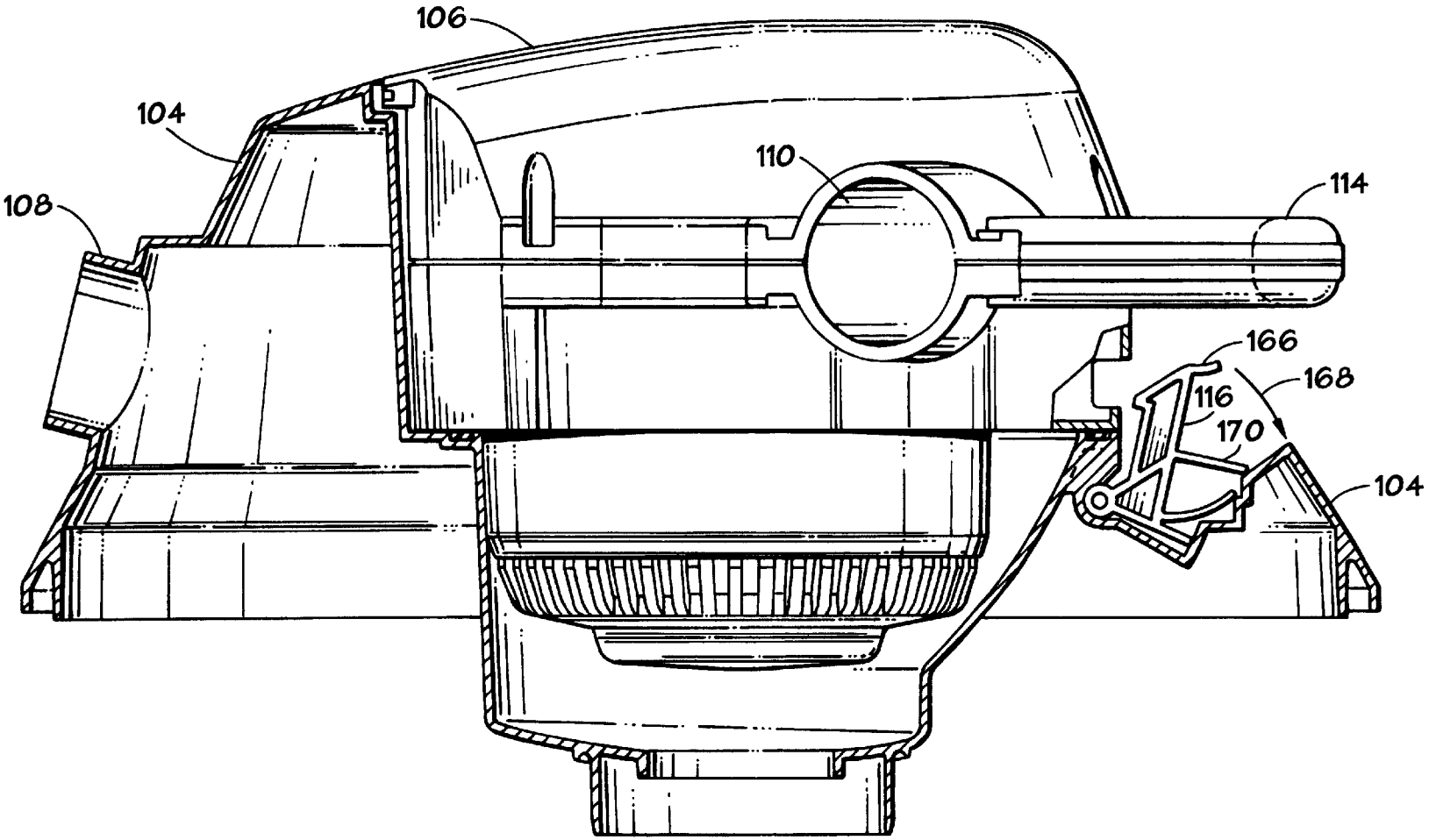
FIG. 13 is a partial side view showing a first stage of detachment of powerhead from the lid of the blower/vac from FIG. 1.

To unlatch powerhead 106 from lid 104, latch 116 is provided with a finger contact surface 166 to which a user simply applies a light force, rotating the latch back in the direction of arrow 168 in FIG. 13. This disengages latching surface 132 from latching rib 134, allowing powerhead 106 to be lifted up. In accordance with one aspect of the invention, this can be a one-handed operation, since the fingers of a hand grasping handle 114 can disengage the latch. Once disengaged, the hand grasping handle 114 can simply lift powerhead 106 up. Cover member 170 on latch 116 covers the open space between the lid 104 and latch 106, preventing fingers from being caught therein.

Latch 116 in accordance with the presently disclosed embodiment is believed to offer several advantages over powerhead latches of the prior art (such as latch 116' discussed above with reference to FIGS. 3 and 4). First, as described above with reference to FIGS. 8–10, no tools or fasteners are required to attach latch to lid 104. This is advantageous in terms of ease and cost of manufacture and assembly. Additionally, notwithstanding the fact that no tools or fasteners are required for installation of latch 116, latch 116 is not subject to nuisance detachment once attached. The operation of retaining member 150 and bearing 154 ensure that latch 116 will not accidentally become dislodged from its socket 136.

A further advantage of latch 116 over the prior art is its multiple wall construction. From FIGS. 3 and 4 it can be observed that some prior art latches comprise a single "wall" or a structural segment, while latch 116 comprises multiple segments, including front member 133, back member 135, bottom member 149, contacting surface 164, transverse reinforcing rib member 137, and so on. This multiple-segment configuration gives latch 116 considerable strength as compared with single-segment prior art designs, making latch 116 less susceptible to deflection under load.

Also, as shown in FIGS. 6 and 7, the ends of journal 138 do not protrude from the rest of latch 116, as in prior art designs such as that discussed above with reference to FIGS. 3, 4*a*, and 4*b*. This prevents applied loads from creating a lever arm on journal 138, causing bending at the latch/journal interface. Instead, loads applied to latch 116 are applied evenly across the width thereof. Since journal 138 is integrally formed with the rest of latch 116, and hence essentially comprises a part thereof, there is considerably more contact area between journal 138 and the body of latch 116. This relieves stress concentrations that can build up on the ends of a more conventional journal or at the journal/latch interface.

The strength and reliability of latch 116 is believed to be enhanced due to the fact that journal 138 is a ring of material spanning the entire width of latch 116, as compared with, for example, the posts 120' previously discussed with reference to FIGS. 4*a* and 4*b*.

In addition, latching surface 132 is braced or gussetted by contact surface 164, front member 133, rear member 135, and transverse rib 137, enabling latching surface 132 to resist bending upward when loaded by blower/vac 100 being lifted by handle 114 when powerhead 106 is still latched to lid 104. Bottom member 149 further provides support to latch 116. This gussetting effect can be further enhanced by providing a central supporting rib or wall-like structure (not shown in the figures) extending perpendicularly between front member 133 and rear member 135. Such a central supporting structure may vertically extend all the way between contacting member 164 and bottom member 149.

Finally, latch 116 is self-actuating, requiring no active step on the part of a user to engage powerhead 106 when powerhead 104 is lowered onto lid 104. As powerhead 106 is placed onto lid 104, latch 116 is temporarily deflected back against the force of spring biasing member 144. Once powerhead 106 is fully seated on lid 104, spring member 144 causes latching surface 132 to engage latching rib 134 with a "snap."

Figure 14:
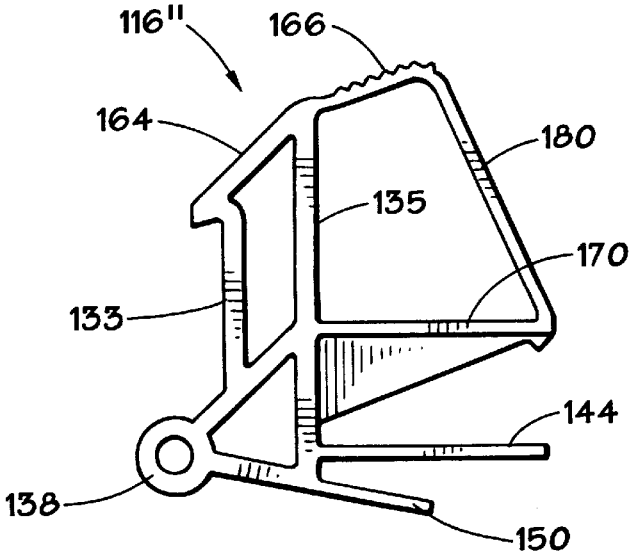
FIG. 14 is a side view of a powerhead latching mechanism in accordance with an alternative implementation of the invention.

In FIG. 14, there is shown a side view of an alternative implementation of latch 116 in accordance with the presently disclosed embodiment of the invention, the alternative implementation of FIG. 14 being designated with double-primed reference numeral 116" (it being understood that those components of latch 116" which are substantially identical in form and function to those in the embodiment of FIGS. 5–13 retain like reference numerals in FIG. 14. The embodiment 116" of FIG. 14 differs from that of FIGS. 5–13 primarily in that the embodiment of FIG. 14 includes a connecting member 180 between finger contact surface 166 and cover member 170. It is believed that the inclusion of connecting member 180 may further enhance the strength and stability of latch 116", and further tends to prevent an operator's fingers from sliding underneath finger contact surface 166 when pushing down thereon.

Figure 15:
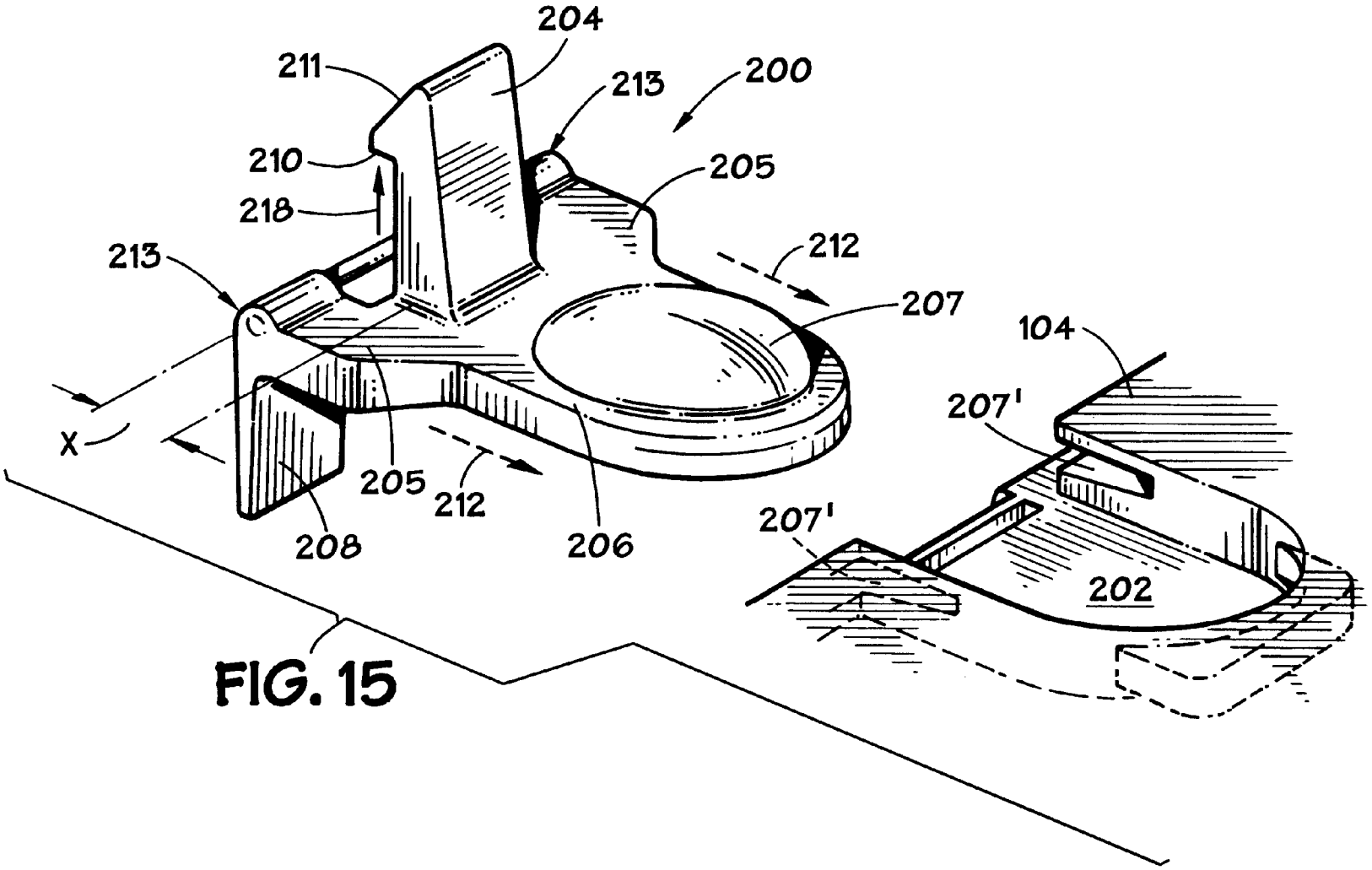
FIG. 15 is an exploded perspective view of a powerhead latching mechanism in accordance with an alternative embodiment of the invention.
Figure 16:
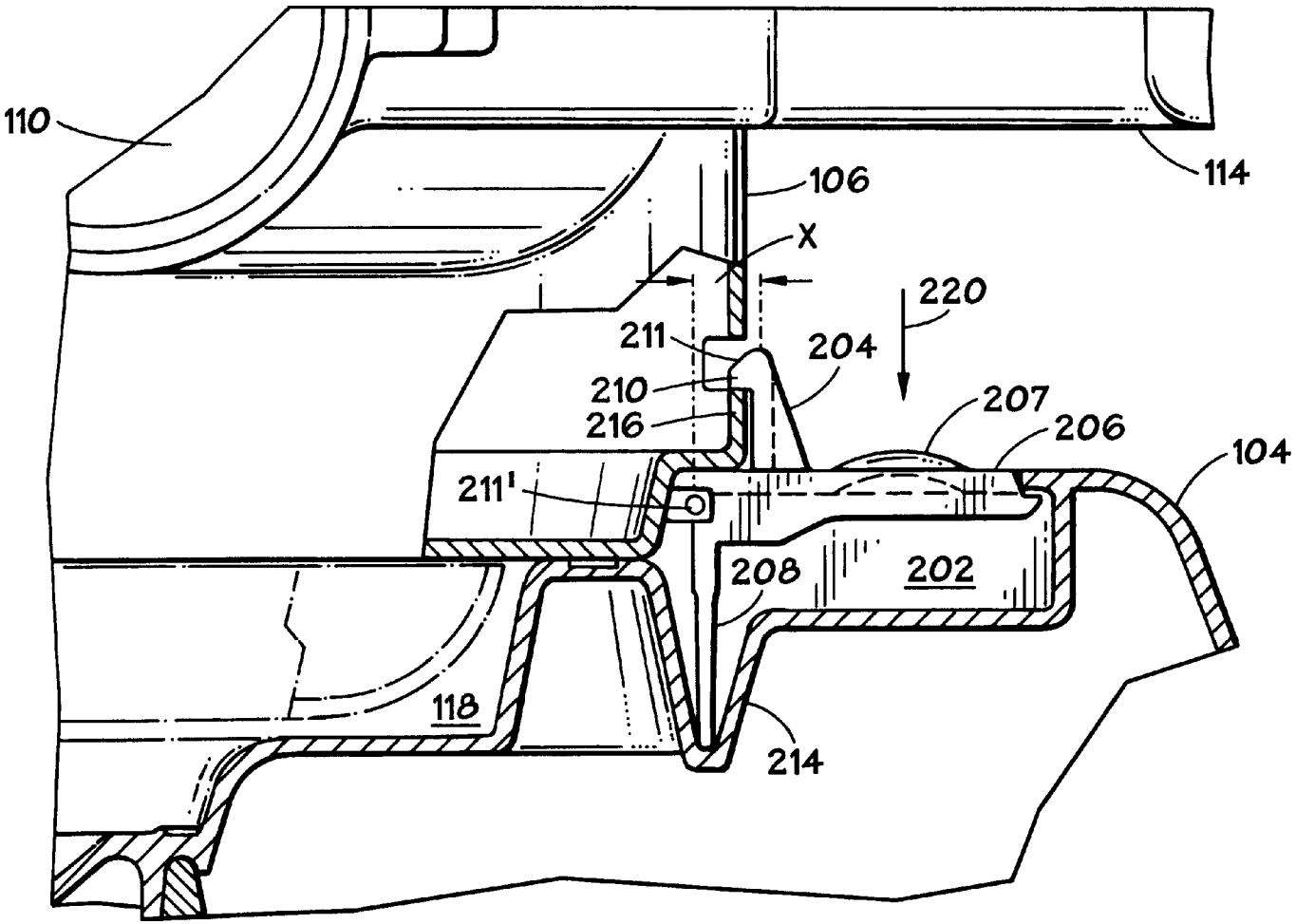
FIG. 16 is a partial cross-sectional view of the latching mechanism from FIG. 14 securing a powerhead to a blower/vac lid.
Figure 17:
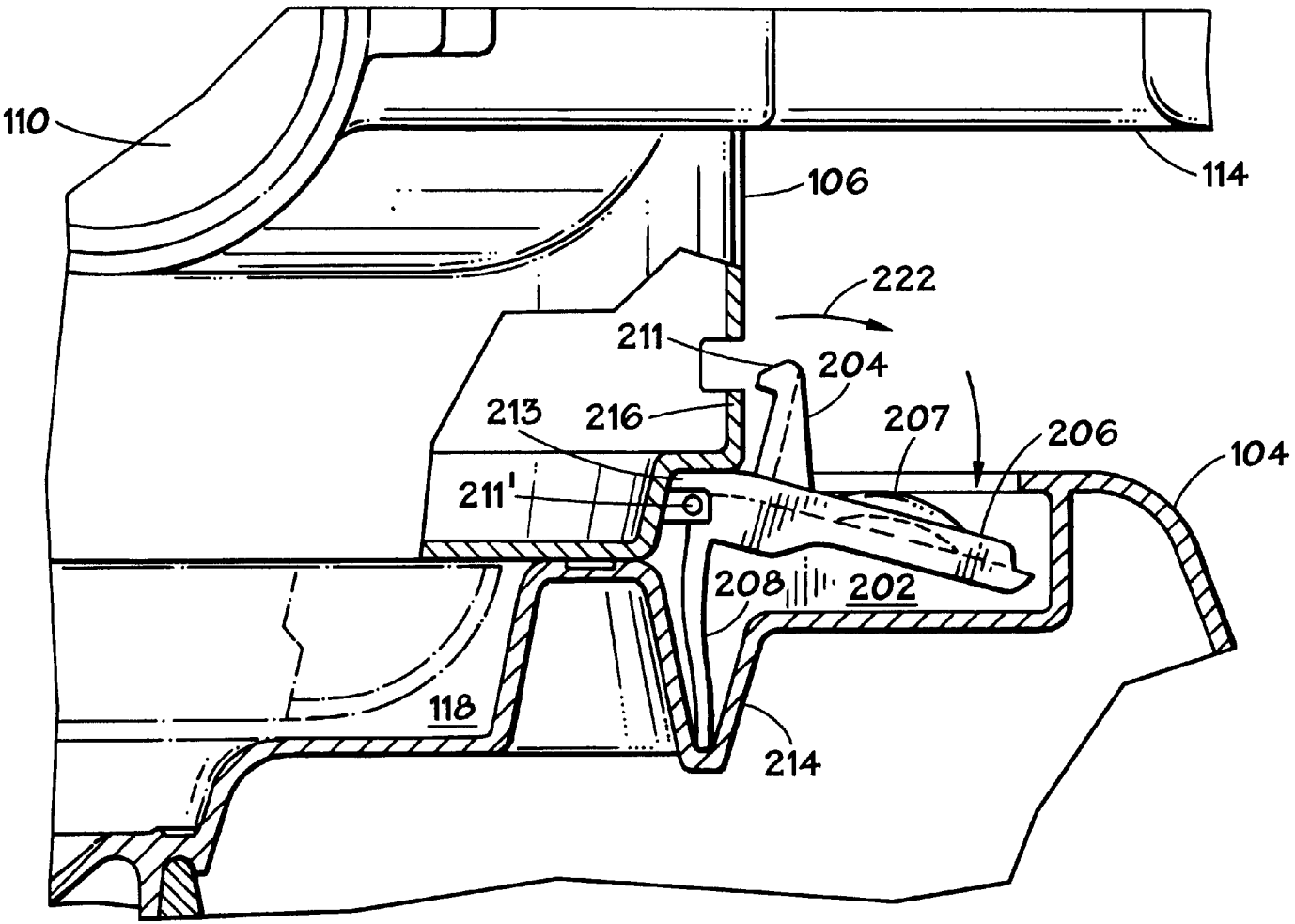
FIG. 17 is a partial cross-sectional view of the latching mechanism from FIG. 14 as the powerhead is being removed from the blower/vac lid.

Turning now to FIGS. 15–17 there is shown a powerhead latching mechanism in accordance with another alternative embodiment of the invention. Referring first to FIG. 15, the latching mechanism in accordance with this alternative embodiment comprises a cantilevered latch 200 adapted to be received in a socket 202 formed in or defined by lid 104 of vacuum 100. (It is to be understood that in FIGS. 15–17, those elements that are substantially identical to those in the earlier Figures will retain identical reference numerals; new reference numerals, such as latch 200 and socket 202, will be used to identify elements that are different in the alternative embodiment of FIGS. 15–17.).

Cantilevered latch 200 is, like latch 116 of the previously disclosed embodiment, preferably a unitary structure made of molded polypropylene or the like. Latch 200 comprises a cantilever member 206 adapted to be received in socket 202. Cantilever member is substantially planar, although a raised portion 207 may be defined on an upper surface thereof to provide a visual and tactile indication of how latch 200 is actuated to release powerhead 106 from lid 104, as will be hereinafter described. Cantilever member 206 is adapted to be secured in socket 202 by engagement of forward shoulders 205 thereof within slots 207 defined alongside socket 202.

A latching member 204 projects upward from cantilever member 206. Latching member 204 is spaced back a distance X from a forward end 213 of cantilever member 206, and projects up substantially perpendicularly to cantilever member 206. Latch 200 further comprises a spring member 208, disposed generally at the forward end 213 of cantilever member 206, and projecting downward substantially perpendicularly to cantilever member 206.

Latching member 204 defines a latching surface 210 for engaging a latching rib 216 defined in powerhead 106. Latching member further defines a contact surface 211 against which powerhead 106 slides during reattachment of powerhead 106 to lid 104.

During assembly, latch 200 is installed in lid 204 by sliding latch 200 into socket 202, as indicated by arrows 212 in FIG. 15. The partially cut-away side cross-sectional view of FIG. 16 shows latch 200 having been installed in this manner. As shown in FIG. 16, when installed in lid 104, the distal end of spring member 208 is received and retained within a spring retaining groove 214 in socket 202.

As in the previous embodiment, in the embodiment of FIGS. 15–17, a recess 118 is defined in lid 104 for receiving powerhead 106, or at least a bottom portion of powerhead 106, therein. FIG. 16 shows latch latching surface 210 of latching member 204 engaging a latching rib 216 defined in the housing of powerhead 106. Notably, as a result of the offset X between front end 213 of cantilever member 206 and latching member 204, a latching moment is induced, such that under load, as represented by arrow 218 in FIG. 15, latch 200 will tend to secure powerhead 106 even more tightly to lid 104.

To release powerhead 106, an operator depresses cantilever member 206 downward into socket 202, as represented by arrow 220 in FIG. 16. This downward force will deflect cantilever member 206 into socket 202, causing a pivoting at the front end 213 of cantilever member 206. This pivoting, in turn, will cause latching member 204 to be deflected back, as shown in FIG. 17 and represented by arrow 222. In this condition, powerhead 106 can be removed from lid 104.

As shown in FIG. 17, the depression of cantilever member 206 and pivoting about the front end 213 of cantilever member 206 also causes deflection of spring member 208, such that when cantilever member is released, latch 200 will return to its "home" position, that which is shown in FIG. 16, under the spring force of resilient spring member 208. This spring biasing makes latch 200 self-actuating; that is, no active measure must be taken to cause latch 200 to engage powerhead 106 with a snap action when it is placed back down on lid 104.

As noted above, when powerhead 106 is lowered back onto lid 104, it will make contact with contact surface 211 of latching member 204, causing latching member 204 to be deflected back; when powerhead 106 is completely lowered into place on lid 104, latching member 204 will "snap" back into engagement with latching rib 216.

From the foregoing detailed description of specific embodiments of the invention, it should be apparent that a wet/dry vacuum appliance with a removable powerhead for separate use as a blower has been disclosed. Although specific embodiments of the invention has been described herein in some detail, it is to be understood that this has been done solely for the purposes of illustrating various aspects and features of the invention, and is not intended to be limiting with respect to the scope of the claims. It is contemplated that various substitutions, alterations, and/or modifications, including but not limited to those design alternatives that may have been specifically noted herein, may be made to the disclosed embodiment without departing from the spirit and scope of the invention, as defined in the appended claims, which follow.

What is claimed is:

1. A vacuum appliance, comprising:

a collection canister having a lid a powerhead, adapted to be removably secured to said collection canister lid;

a latch for removably securing said powerhead to said lid, said latch being disposed in a latch socket formed in said lid, and said latch having a journal adapted to be received within a bearing defined in said latch socket for permitting pivotal motion of said latch with respect to said lid;

said latch further comprising a front member and a rear member, a transverse rib member extending from said journal and extending between said front and rear members, a contacting member extending between said front and rear members and generally defining a top of said latch, a bottom member extending between said journal and said rear member, and a retaining member extending generally rearwardly from said rear member;

wherein said latch socket is configured such that said latch is secured within said socket by said retaining member contacting a bearing surface, concentric to said first bearing defined in said socket.

2. A vacuum appliance in accordance with claim 1, wherein said front member, rear member, transverse rib member, contacting member, bottom member, and retaining member are all substantially planar, said front and rear members being spaced apart and substantially parallel to one another.

3. A vacuum appliance in accordance with claim 2, wherein said latch is a unitary structure.

4. A vacuum appliance in accordance with claim 3, wherein said latch is made of molded polypropylene.

5. A vacuum appliance in accordance with claim 1, wherein said latch further comprises a spring biasing member, extending generally rearwardly from said rear member, for biasing said latch to pivot to a home position in said socket.

6. A vacuum appliance in accordance with claim 5, wherein:

said front member, rear member, transverse rib member, contacting member, bottom member, retaining member, and spring biasing member are all substantially planar, said front and rear members being spaced apart and substantially parallel to one another;

and wherein said spring biasing member biases said latch to said home position by contacting and deflecting against a spring wall defined in said latch socket.

7. A vacuum appliance in accordance with claim 1, wherein said powerhead has a latching rib defined thereon, such that when said powerhead is lowered into said recess, said latch automatically engages said latching rib.

8. A vacuum appliance, comprising:

a collection canister having a lid;

a powerhead, adapted to be removably secured to said collection canister lid;

latch means for removably securing said powerhead to said lid, said latch means being disposed in a socket formed in said lid, and said latch having journal means adapted to be received within a bearing defined in said socket for permitting pivotal motion of said latch means with respect to said lid;

said latch means further comprising a front member and a rear member, a transverse rib member extending from said journal and extending between said front and rear members, a contacting member extending between said front and rear members and generally defining a top of said latch, a bottom member, extending between said journal and said rear member, and retaining means extending generally rearwardly from said rear member;

wherein said socket is configured such that said latch means is secured within said socket by said retaining means engaging an auxiliary bearing defined in said socket.

9. A vacuum appliance in accordance with claim 8, wherein said front member, rear member, transverse rib member, contacting member, bottom member, and retaining means are all substantially planar, said front and rear members being spaced apart and substantially parallel to one another.

10. A vacuum appliance in accordance with claim 9, wherein said latch means is a unitary structure.

11. A vacuum appliance in accordance with claim 10, wherein said latch means is made of molded polypropylene.

12. A vacuum appliance in accordance with claim 8, wherein said latch means further comprises spring biasing means, extending generally rearwardly from said rear member, for biasing said latch means to pivot to a home position in said socket.

13. A vacuum appliance in accordance with claim 12, wherein:

said front member, rear member, transverse rib member, contacting member, retaining means, bottom member, and spring biasing means are all substantially planar, said front and rear members being spaced apart and substantially parallel to one another;

and wherein said spring biasing means biases said latch to said home position by contacting and deflecting against a spring wall defined in said latch socket.

14. A vacuum appliance in accordance with claim 8, wherein said powerhead has a latching rib means defined thereon, such that when said powerhead is lowered into said recess, said latch automatically engages said latching rib means.

15. A latch for removably securing a powerhead to a lid of a vacuum appliance, said latch comprising:

a journal adapted to be received within a bearing defined in a latch socket defined in said lid, said journal permitting pivotal motion of said latch with respect to said lid;

a front member and a rear member;

a transverse rib member extending from said journal and extending between said front and rear members;

a contacting member extending between said front and rear members and generally defining a top of said latch;

a bottom member coupled between said journal and said rear member; and a retaining member extending generally rearwardly from said rear member;

wherein said latch socket is configured such that said latch is secured within said socket by said retaining member engaging an auxiliary bearing defined in said socket;

wherein said front member, rear member, transverse rib member, contacting member, bottom member, and retaining member are all substantially planar, said front and rear members being spaced apart and substantially parallel to one another;

and wherein said latch is a unitary structure.

16. A latch in accordance with claim 15, wherein said latch is made of molded polypropylene.

17. A latch in accordance with claim 15, wherein said latch further comprises a spring biasing member, extending generally rearwardly from said rear member, for biasing said latch to pivot to a home position in said socket;

and wherein said front member, rear member, transverse rib member, contacting member, bottom member, retaining member, and spring biasing member are all substantially planar, said front and rear members being spaced apart and substantially parallel to one another;

and wherein said spring biasing member biases said latch to said home position by contacting and deflecting against a spring wall defined in said latch socket.

18. A latch in accordance with claim 17, wherein:

said front member, rear member, transverse rib member, contacting member, bottom member, retaining member, and spring biasing member are all substantially planar, said front and rear members being spaced apart and substantially parallel to one another;

and wherein said spring biasing member biases said latch to said home position by contacting and deflecting against a spring wall defined in said latch socket.

19. A latch in accordance with claim 15, wherein said powerhead has a latching rib defined thereon, such that when said powerhead is lowered into said recess, said latch automatically engages said latching rib.

20. A vacuum appliance, comprising:

a collection canister having a lid a powerhead, adapted to be removably secured at least partially within a recess defined in said collection canister lid;

a latch for removably securing said powerhead to said lid, said latch being disposed in a latch socket formed in said lid;

wherein said latch comprises:

a substantially planar cantilever member;

a latching member, spaced back from a forward end of said cantilever member and projecting substantially perpendicularly up therefrom;

a spring member, disposed generally at said forward end of said cantilever member and projecting substantially perpendicularly down therefrom;

said vacuum appliance further comprising:

wherein said latch socket is adapted to receive said cantilever member therein such that said latching member projects upward from said lid, said latch socket defining a spring retaining groove for securing a distal end of said spring member;

and wherein when said powerhead is lowered into said recess, said latching member engages a latching rib defined on said powerhead, thereby securing said powerhead to said lid.

21. A vacuum appliance in accordance with claim 20, wherein said socket is adapted to allow a rear portion of said cantilever member to be depressed downward therein, such that said latching member is deflected back, disengaging from said latching rib on said powerhead.

22. A vacuum appliance in accordance with claim 21, wherein said latching member back defines a contacting surface against which said powerhead slides when said powerhead is lowered into said recess, thereby deflecting said latching member.

23. A vacuum appliance in accordance with claim 20, wherein said latch is made of polypropylene.

24. A vacuum appliance in accordance with claim 20, wherein said latch automatically engages said latching rib when said powerhead is lowered into said recess.

25. A latch for removably securing a powerhead at least partially within a recess formed in a lid of a vacuum appliance, said latch adapted to be disposed in a latch socket formed in said lid, wherein said latch comprises:

a substantially planar cantilever member;

a latching member, spaced back from a forward end of said cantilever member and projecting substantially perpendicularly up therefrom;

a spring member, disposed generally at said forward end of said cantilever member and projecting substantially perpendicularly down therefrom;

wherein said latch socket is adapted to receive said cantilever member therein such that said latching member projects upward from said lid, said socket defining a spring retaining groove for securing a distal end of said spring member;

wherein when said powerhead is lowered into said recess, said latching member engages a latching rib defined on said powerhead, thereby securing said powerhead to said lid;

and wherein said latch is a unitary structure.

26. A latch in accordance with claim 25, wherein said socket is adapted to allow a rear portion of said cantilever member to be depressed downward therein, such that said latching member is deflected back, disengaging from said latching rib on said powerhead.

27. A latch in accordance with claim 26, wherein said latching member back defines a contacting surface against which said powerhead slides when said powerhead is lowered into said recess, thereby deflecting said latching member.

28. A latch in accordance with claim 25, wherein said latch is made of polypropylene.

29. A latch in accordance with claim 25, wherein said latch automatically engages said latching rib when said powerhead is lowered into said recess.

30. A vacuum appliance, comprising:

a collection canister having a lid a powerhead, adapted to be removably secured to said collection canister lid;

a latch for removably securing said powerhead to said lid, said latch being disposed in a latch socket formed in said lid, and said latch having a journal adapted to be received within a bearing defined in said latch socket for permitting pivotal motion of said latch with respect to said lid;

said latch further comprising a retaining member adapted to engage an auxiliary bearing defined by said latch socket and ride against an auxiliary bearing surface thereof as said latch is permitted to pivot about said journal, said auxiliary bearing surface being concentric with said bearing.

31. A vacuum appliance in accordance with claim 30, wherein said latch socket defines a bump wall configured to limit the extent of pivotal movement of said latch in said socket in a first direction.

32. A vacuum appliance in accordance with claim 31, wherein said limited extent of pivotal movement is such that said retaining member is prevented from disengaging said auxiliary bearing.

33. A vacuum appliance in accordance with claim 31, wherein said latch is made of molded polypropylene.

34. A vacuum appliance in accordance with claim 30, wherein said latch is a unitary structure.

35. A vacuum appliance in accordance with claim 30, wherein said latch further comprises a rearwardly-extending spring biasing member for biasing said latch to pivot to a home position in said socket.

* * * * *